US011776737B2

(12) United States Patent
Wang et al.

(10) Patent No.: US 11,776,737 B2
(45) Date of Patent: Oct. 3, 2023

(54) INDUCTOR ELEMENT

(71) Applicant: TDK CORPORATION, Tokyo (JP)

(72) Inventors: Chen Wang, Tokyo (JP); Satoshi Sugimoto, Tokyo (JP)

(73) Assignee: TDK CORPORATION, Tokyo (JP)

( * ) Notice: Subject to any disclaimer, the term of this patent is extended or adjusted under 35 U.S.C. 154(b) by 471 days.

(21) Appl. No.: 17/009,909

(22) Filed: Sep. 2, 2020

(65) Prior Publication Data

US 2021/0090785 A1 Mar. 25, 2021

(30) Foreign Application Priority Data

Sep. 19, 2019 (JP) ..... 2019-170385

(51) Int. Cl.
*H01F 27/29* (2006.01)
*H01F 27/24* (2006.01)

(52) U.S. Cl.
CPC ..... *H01F 27/292* (2013.01); *H01F 27/24* (2013.01)

(58) Field of Classification Search
CPC ..... H01F 27/292; H01F 27/24
See application file for complete search history.

(56) References Cited

U.S. PATENT DOCUMENTS 7,248,139 B1 * 7/2007 Podlisk ..... H01F 27/2847 336/232
8,674,802 B2 * 3/2014 Ikriannikov ..... H02M 3/02 336/170
9,336,941 B1 * 5/2016 Ikriannikov ..... H01F 27/306
10,325,715 B2 * 6/2019 Knoll ..... H01F 27/292
2004/0017276 A1 * 1/2004 Chen ..... H01F 27/027 336/192
2004/0160298 A1 * 8/2004 Hsu ..... H01F 27/292 336/83
2007/0175701 A1 * 8/2007 Xu ..... H01F 37/00 182/111
2007/0252669 A1 * 11/2007 Hansen ..... H01F 17/06 336/212
2008/0012674 A1 1/2008 Sano et al.
(Continued)

FOREIGN PATENT DOCUMENTS

JP S50-76559 A * 6/1975 ..... H05K 7/00
JP S50-76559 A 6/1975
(Continued)

*Primary Examiner* — Marlon T Fletcher
*Assistant Examiner* — Malcolm Barnes
(74) *Attorney, Agent, or Firm* — Oliff PLC

(57) ABSTRACT

An inductor element includes a core including a first core portion and a second core portion that are disposed to face each other in a first direction; and a conductor including a first mounting portion and a second mounting portion that are exposed from the core at a predetermined interval therebetween on one side of a second direction orthogonal to the first direction, and a connecting portion which connects the first mounting portion and the second mounting portion and of which at least a part is interposed between the first core portion and the second core portion. The first mounting portion and the second mounting portion are disposed to overlap both of the first core portion and the second core portion as seen from the second direction.

11 Claims, 18 Drawing Sheets

(56) References Cited

U.S. PATENT DOCUMENTS

| | | | | |
|---|---|---|---|---|
| 2011/0043317 | A1* | 2/2011 | Ikriannikov | H01F 17/06 336/192 |
| 2015/0009004 | A1* | 1/2015 | Zhou | H01F 27/292 29/606 |
| 2015/0170820 | A1* | 6/2015 | Kadir | H01F 27/306 29/606 |
| 2017/0047155 | A1* | 2/2017 | Yao | H01F 17/04 |
| 2017/0178794 | A1* | 6/2017 | Yan | H01F 41/02 |

FOREIGN PATENT DOCUMENTS

| | | | |
|---|---|---|---|
| JP | H04-99807 | U | 8/1992 |
| JP | 2000-068129 | A | 3/2000 |
| JP | 2009-535804 | A | 10/2009 |
| WO | 2006/070544 | A1 | 7/2006 |

* cited by examiner

INDUCTOR ELEMENT

BACKGROUND OF THE INVENTION

1. Field of the Invention

The present invention relates to an inductor element used in an electrical circuit or the like.

2. Description of the Related Art

As an inductor element that can handle a high current value, has a relatively low L value, and is required to have a high magnetic saturation property, there is proposed an inductor element in which a conductor of less than 1T is covered with a magnetic material. In addition, such an inductor element may be required to be reduced in thickness for the purpose of reducing a mounting area.
Patent Document 1: WO 2006/070544 A

SUMMARY OF THE INVENTION

However, in the inductor element having a structure of the related art, when the element is reduced in thickness, the width of the conductor provided in the element is also reduced, and thus the width of a mounting portion where the conductor is exposed and formed is also reduced. For this reason, there occurs a problem that the element is likely to fall over in the period from after the element is disposed on a substrate until joining by soldering or the like is completed.

The invention is made in light of such circumstances, and an object of the invention is to provide an inductor element in which the element can be prevented from falling over even if the element is thin.

In order to achieve the above object, according to an aspect of the invention, there is provided an inductor element including: a core including a first core portion and a second core portion that are disposed to face each other in a first direction; and a conductor including a first mounting portion and a second mounting portion that are exposed from the core and disposed apart from each other on one side of a second direction orthogonal to the first direction, and a connecting portion passing between the first core portion and the second core portion to connect the first mounting portion and the second mounting portion, in which the first mounting portion and the second mounting portion are disposed to overlap both of the first core portion and the second core portion as seen from the second direction.

In the inductor element according to the aspect of the invention, the first mounting portion and the second mounting portion are disposed to overlap both of the first core portion and the second core portion as seen from the second direction. Even if the inductor element including such mounting portions is a thin inductor element having a short length in the first direction that is a direction where the first core portion and the second core portion face each other, wide widths in the first direction of the mounting portions can be secured. In addition, since the first mounting portion and the second mounting portion are disposed across the first core portion and the second core portion, the center position in the first direction of the core and the center positions in the first direction of the first and second mounting portions can be easily brought close to each other. Therefore, in the inductor element according to the aspect of the invention, even if the element is thin, the element can be effectively prevented from falling over.

In addition, for example, the connecting portion may include a first connecting portion extending from the first mounting portion along the second direction, a second connecting portion extending from the second mounting portion along the second direction, and a third connecting portion that connects the first connecting portion and the second connecting portion on the other side of the second direction along a third direction orthogonal to the first direction and the second direction.

A length along the first direction of a cross section of each of the first connecting portion and the second connecting portion, the cross section being orthogonal to the second direction that is a direction of a current, may be shorter than a length along the third direction of the cross section.

In such an inductor element, since the first connecting portion and the second connecting portion that pass through the inside of the core have a plate shape and the length in the first direction of the cross section of each of the first connecting portion and the second connection portion is short, the length in the first direction of the entire inductor element can be shortened, and thus the inductor element has an advantage of a reduction in thickness. In addition, since the length in the third direction of the cross section of each of the connecting portions is long, the cross-sectional area of each of the connecting portions can be widened, and thus the resistance of the inductor element can be reduced and the element capable of handling a large current can be realized.

In addition, for example, the third connecting portion may be disposed on the same plane as the first connecting portion and the second connecting portion.

Since the connecting portions including the first to third connecting portions have a plate shape extending along the same plane, the inductor element including such connecting portions has a particular advantage of a reduction in thickness.

In addition, for example, at least a part of the third connecting portion may have a plate shape extending perpendicular to the first connecting portion and the second connecting portion.

Since the at least a part of the third connecting portion extends perpendicular to the first and second connecting portions, the property of the element can be improved while the height of the element is suppressed. Incidentally, in this case, the third connecting portion may extend substantially perpendicular to the first connecting portion and the second connecting portion, and may not necessarily extend strictly perpendicular thereto.

In addition, for example, the first mounting portion may include a first wide portion of which a length along the first direction is longer than lengths along the first direction of both of the first core portion and the second core portion.

The second mounting portion may include a second wide portion of which a length along the first direction is longer than the lengths along the first direction of both of the first core portion and the second core portion.

The first wide portion may be disposed close to a first side surface that is a side surface parallel to the first direction and the second direction among side surfaces of the core and is closer to the first mounting portion than to the second mounting portion.

The second wide portion may be disposed close to a second side surface that is a side surface parallel to the first direction and the second direction among the side surfaces of the core and is closer to the second mounting portion than to the first mounting portion.

In such an inductor element, since the first wide portion and the second wide portion are disposed very close to the first side surface and the second side surface, respectively, stability in the mounting posture of the element is improved, and thus the element can be more suitably prevented from falling over. In addition, since the first wide portion and the second wide portion in which fillets are easily formed by a joining material such as a solder during mounting are disposed very close to the first side surface and the second side surface, a visual inspection on such an inductor element can be easily performed to confirm that the inductor element is properly joined to a substrate. Incidentally, in this case, the first side surface and the second side surface may be substantially parallel to the first direction and the second direction, and may not be necessarily strictly parallel thereto.

In addition, for example, the first mounting portion may include a first cutout portion that is disposed further apart from the first side surface than the first wide portion.

The second mounting portion may include a second cutout portion that is disposed further apart from the second side surface than the second wide portion.

Since such cutout portions are provided, the first wide portion and the second wide portion can be formed with good dimensional accuracy in a direction perpendicular to the connecting portions.

In addition, for example, the first mounting portion and the second mounting portion may be disposed between the first side surface and the second side surface that are two side surfaces parallel to the first direction and the second direction among side surfaces of the core as seen from the second direction, and may be disposed between a third side surface and a fourth side surface that are two side surfaces parallel to a third direction, which is orthogonal to the first direction and the second direction, and the second direction among the side surfaces of the core.

In such an inductor element, as seen from the second direction, the first mounting portion and the second mounting portion are formed not to protrude from the side surfaces of the core. For this reason, such an inductor element has an advantage of a reduction in thickness, and contributes to a reduction in mounting area. Incidentally, in this case, regarding the relationship of perpendicularity and parallelism between surfaces and directions, the surfaces and directions may be substantially perpendicular or substantially parallel to each other, and the surfaces and directions are not necessarily strictly perpendicular or parallel to each other.

In addition, for example, the core may include a protrusion portion which protrudes to the one side of the second direction so that a lower end surface of the protrusion portion is positioned between the first mounting portion and the second mounting portion.

Since the inductor element including such a protrusion portion has improved stability in mounting posture, the element can be more suitably prevented from falling over.

In addition, for example, a length along the first direction of the core may be shorter than a length along the second direction of the core and a length along a third direction of the core, the third direction being orthogonal to the first direction and the second direction.

The shape of the core in the inductor element according to the aspect of the invention is not particularly limited; however, particularly, a core having a short length in the first direction has a large effect in reducing the thickness and preventing the element from falling over.

DETAILED DESCRIPTION OF THE PREFERRED EMBODIMENTS

First Embodiment

Figure 1:
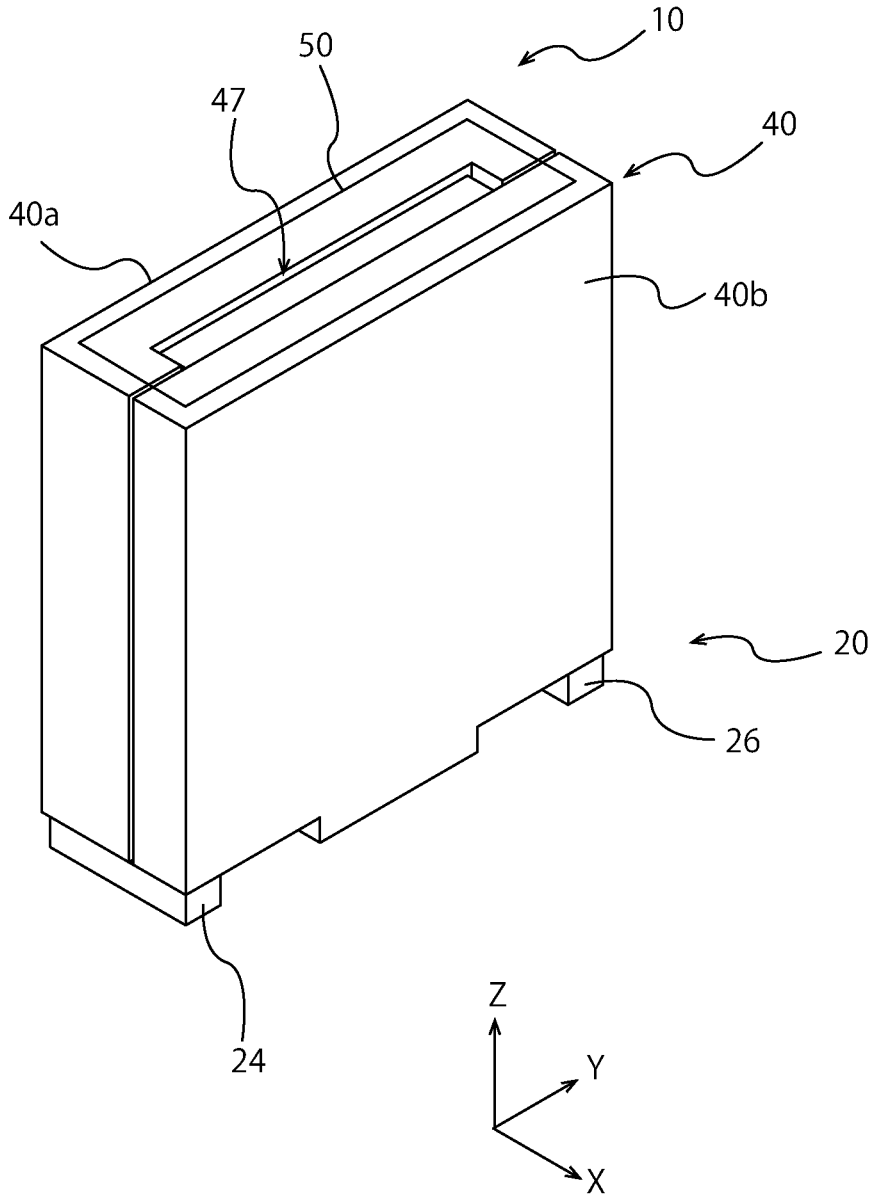
FIG. 1 is a perspective view of an inductor element according to a first embodiment of the invention as seen from diagonally above.

FIG. 1 is a perspective view of an inductor element 10 according to one embodiment of the invention as seen from diagonally above. The inductor element 10 includes a core 40 having a substantially rectangular parallelepiped outer shape and a conductor 20 including a first mounting portion 24 and a second mounting portion 26 that are exposed from the inside of the core 40. The core 40 includes a first core portion 40*a* and a second core portion 40*b* that are disposed to face each other in a first direction (X-axis direction).

Figure 5:
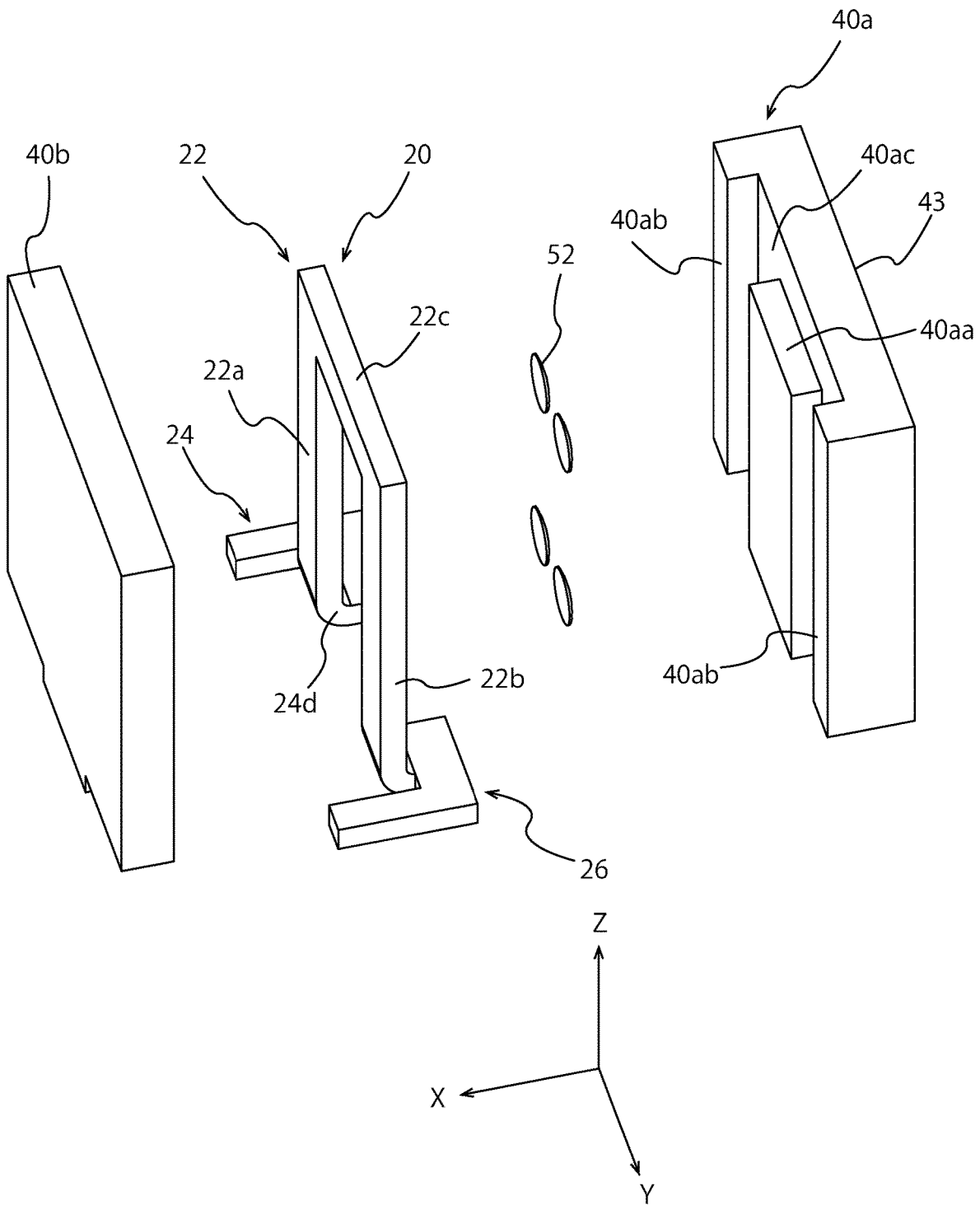
FIG. 5 is an exploded perspective view of the inductor element illustrated in FIG. 1.

FIG. 5 is an exploded perspective view of the inductor element 10. Two side portions 40*ab* and one central portion 40*aa* that protrude toward the second core portion 40*b* are formed in a surface of the first core portion 40*a*, which faces the second core portion 40*b*. The side portions 40*ab* and the central portion 40*aa* extend parallel to each other along a second direction (Z-axis direction) orthogonal to the first direction.

As illustrated in FIG. 5, the two side portions 40*ab* are disposed in both end portions of the first core portion 40*a* in a third direction (Y-axis direction) orthogonal to the first direction and the second direction, and the central portion 40*aa* is disposed in a central portion in the third direction and between the two side portions 40*ab*. A groove portion 40*ac* that accommodates a connecting portion 22 of the conductor 20 is formed between the side portion 40*ab* and the central portion 40*aa* and above the central portion 40*aa*.

The second core portion 40*b* has a tabular outer shape. The second core portion 40*b* is joined to the central portion 40*aa* and/or the side portions 40*ab* of the first core portion 40*a* with an adhesive 52 or the like. Gaps may be formed between the second core portion 40*b* and the central portion 40*aa*, and the second core portion 40*b* and the side portions 40*ab* so as to prevent magnetic saturation. In that case, the gap between the second core portion 40*b* and the central portion 40*aa* may be equal to or may be different from the gap between the second core portion 40*b* and the side portions 40*ab*.

As illustrated in FIG. 5, the core 40 is an EI type core that is a combination of the first core portion 40*a* that is an E type and the second core portion 40*b* that is an I type; however, the core 40 of the inductor element 10 is not limited thereto, and may be a combination of other asymmetrical cores or a combination of symmetrical cores. Examples of the material of the core 40 include iron, other metals, alloys, or ferrite; however, the material is not particularly limited as long as the material is magnetic.

As illustrated in FIG. 5, the conductor 20 includes two mounting portions, namely, the first mounting portion 24 and the second mounting portion 26 and the connecting portion 22 that connects the first mounting portion 24 and the second mounting portion 26. The connecting portion 22 passes between the first core portion 40*a* and the second core portion 40*b* to connect the first mounting portion 24 and the second mounting portion 26.

Figure 2:
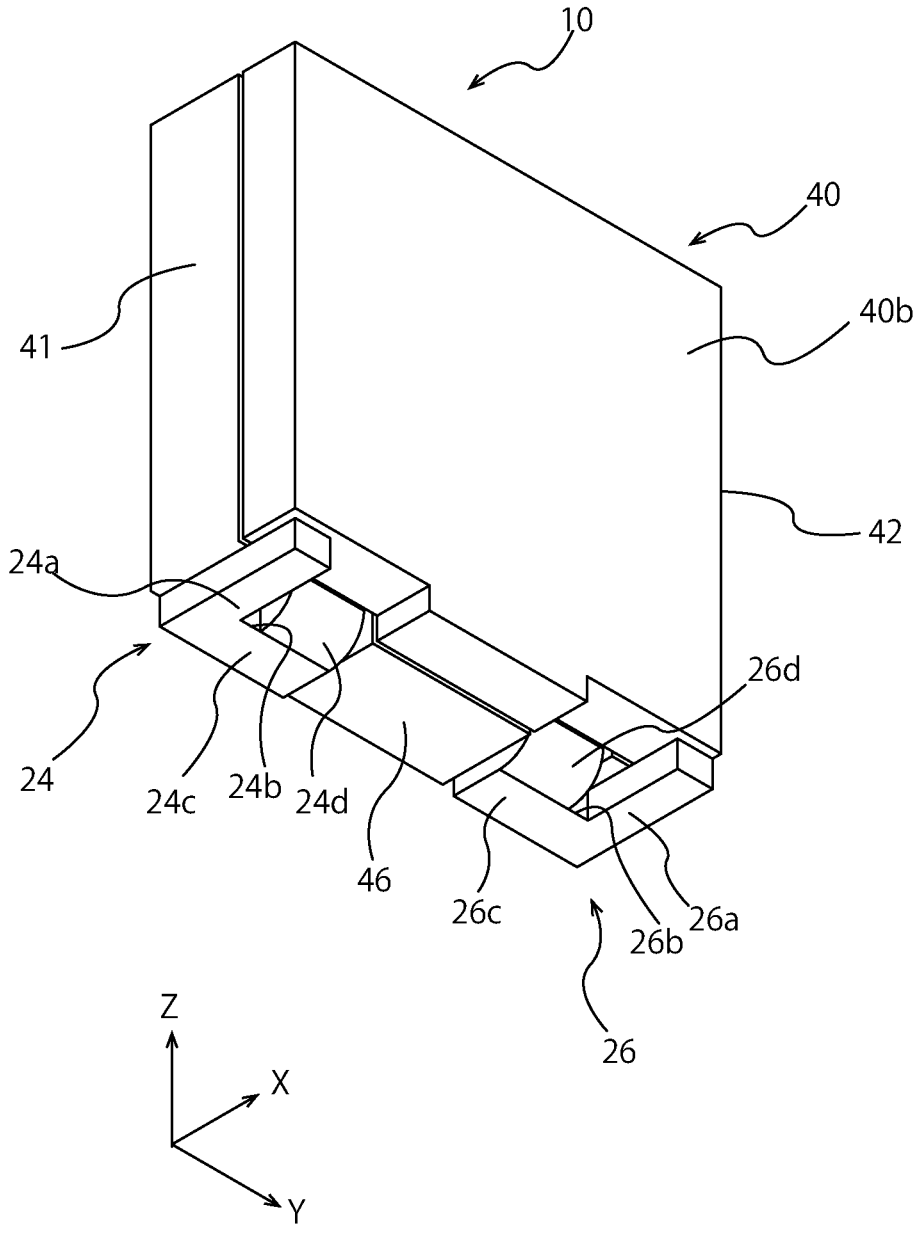
FIG. 2 is a perspective view of the inductor element illustrated in FIG. 1 as seen from diagonally below.

FIG. 2 is a perspective view of the inductor element 10 as seen from diagonally below. The first mounting portion 24 and the second mounting portion 26 are exposed from the core 40 on a Z-axis negative direction side which is one side of the second direction. The first mounting portion 24 and the second mounting portion 26 are disposed apart from each other at a predetermined interval in the third direction. Incidentally, the inductor element 10 will be described based on the assumption that a direction where the first core portion 40*a* and the second core portion 40*b* face each other is the first direction (X-axis direction), an upward and downward direction orthogonal to the first direction and perpendicular to a mounting surface is the second direction (Z-axis direction), and a direction orthogonal to the first direction and the second direction is the third direction (Y-axis direction).

Figure 3:
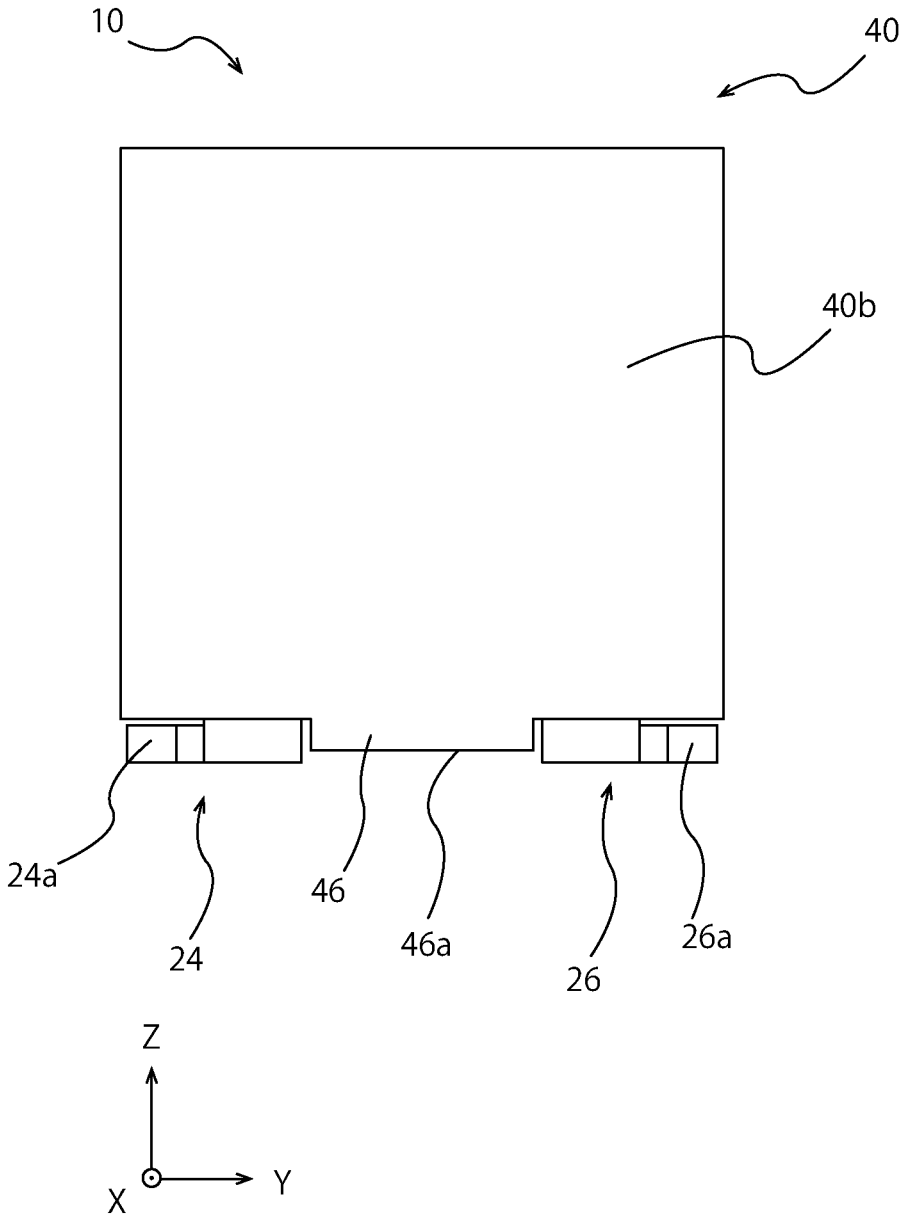
FIG. 3 is a front view of the inductor element illustrated in FIG. 1.

As illustrated in FIG. 3 that is a front view, the inductor element 10 is used in a state where the first mounting portion 24 and the second mounting portion 26 are mounted on a mounting substrate while taking a posture to face a land (unillustrated). The size (outer dimensions) of the inductor element 10 is not particularly limited and may be, for example, 3 to 20 mm in the X-axis direction, 3 to 20 mm in the Y-axis direction, and 3 to 20 mm in the Z-axis direction.

As illustrated in FIG. 1, except the first mounting portion 24 and the second mounting portion 26 that are exposed below the inductor element 10, the conductor 20 is accommodated inside the core 40. Namely, as illustrated in FIG. 5, the connecting portion 22 that connects the first mounting portion 24 and the second mounting portion 26 is accommodated inside the core 40.

As illustrated in FIG. 5, the connecting portion 22 includes a first connecting portion 22*a*, a second connecting portion 22*b*, and a third connecting portion 22*c*. The first connecting portion 22*a* has a plate shape extending from the first mounting portion 24 in the second direction (Z-axis direction), and the second connecting portion 22*b* has a plate shape extending from the second mounting portion 26 in the second direction (Z-axis direction). The third connecting portion 22*c* connects the first connecting portion 22*a* and the second connecting portion 22*b* on the other side of the second direction (Z-axis positive direction side) along the third direction (Y-axis direction).

The connecting portion 22 has a U shape that opens downward (Z-axis negative direction side), and the third connecting portion 22*c* is disposed on the same plane as the first connecting portion 22*a* and the second connecting portion 22*b*. Examples of the material of the conductor 20 including the first mounting portion 24, the second mounting portion 26, and the connecting portion 22 include good conductors of metals such as copper, copper alloys, silver, and nickel; however, the material is not particularly limited as long as the material is conductive. The conductor 20 is formed, for example, by machining a metal plate material. However, the method for forming the conductor 20 is not limited thereto.

Figure 6:
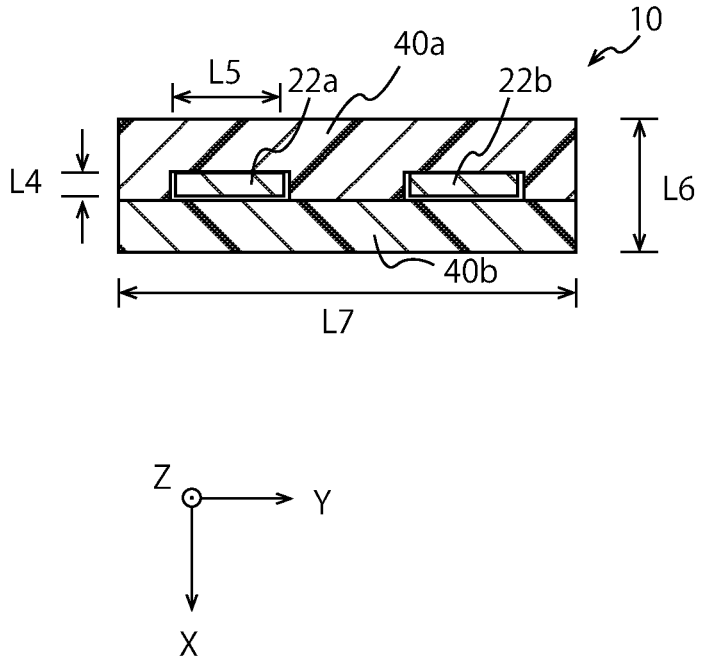
FIG. 6 is a cross-sectional view of the inductor element illustrated in FIG. 1.

FIG. 6 is a cross-sectional view of the inductor element 10. In the first connecting portion 22*a* and the second connecting portion 22*b* of the conductor 20, a length L4 along the first direction (X-axis direction) of a cross section orthogonal to the second direction (Z-axis direction) that is the direction of a current is shorter than a length L5 along the third direction (Y-axis direction) of the cross section. In addition, the first connecting portion 22*a* and the second connecting portion 22*b* are disposed such that a thickness direction of a plate material forming the first connecting portion 22*a* and the second connecting portion 22*b* is the first direction (X-axis direction) and the surface of the plate material is parallel to a Y-Z plane.

Since the length in the first direction (X-axis direction) of the connecting portion 22 described above is short, the length in the first direction (X-axis direction) of the core 40 accommodating the connecting portion 22 can be also shortened. Therefore, the inductor element 10 including the connecting portion 22 described above has an advantage of a reduction in thickness. The cross-sectional area of the first connecting portion 22*a* and the second connecting portion 22*b* is appropriately determined according to the value of a current flowing through the conductor 20, the size of the inductor element 10, or the like, and may be, for example, approximately 0.1 to 10 $mm^2$.

Figure 4:
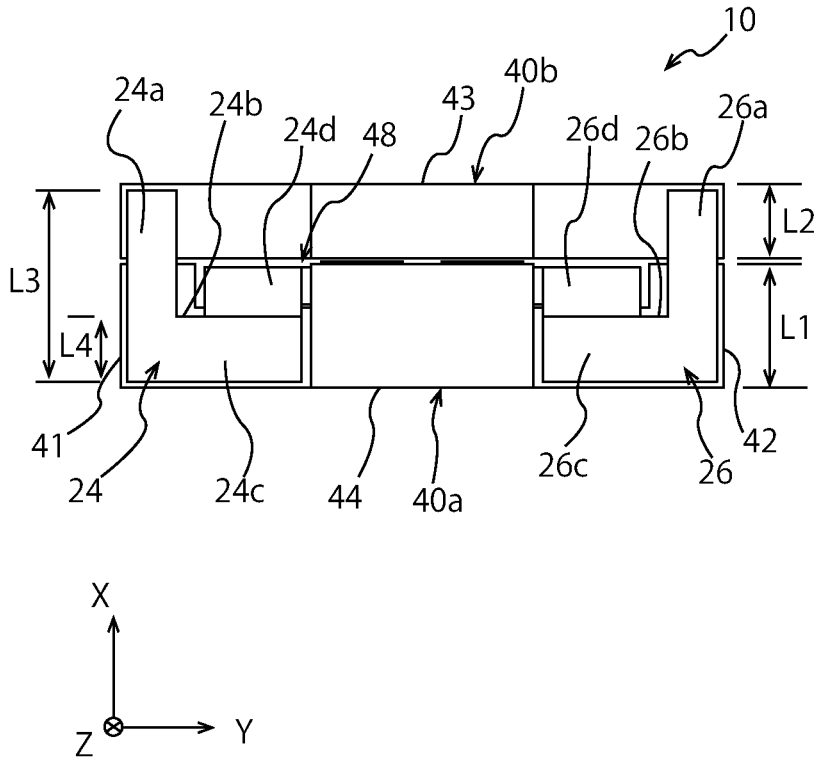
FIG. 4 is a bottom view of the inductor element illustrated in FIG. 1.

FIG. 4 is a bottom view of the inductor element 10 illustrated in FIG. 1 as seen from the one side of the second direction (Z-axis negative direction side). As illustrated in FIG. 4, the first mounting portion 24 and the second mounting portion 26 are exposed outside the core 40 from a lower opening 48 of the core 40. The first mounting portion 24 and the second mounting portion 26 are disposed to overlap both of the first core portion 40*a* and the second core portion 40*b* as seen from the second direction (Z-axis direction).

As illustrated in FIGS. 2 and 4, the first mounting portion 24 includes a first wide portion 24*a*, a first cutout portion 24*b*, a first narrow portion 24*c*, and a first bent portion 24*d*. The first wide portion 24*a* and a first narrow portion 24*c* extend along the same plane parallel to the first direction (X-axis direction) and the third direction (Y-axis direction). The first bent portion 24*d* connects the first connecting portion 22*a* (refer to FIG. 5) parallel to the Y-Z plane and the first narrow portion 24*c* parallel to an X-Y plane. As illustrated in FIG. 5, the plate material forming the conductor 20 is bent 90° in the first bent portion 24*d*.

As illustrated in FIG. 4, a length L3 along the first direction (X-axis direction) of the first wide portion 24*a* is longer than lengths L1 and L2 along the first direction of both of the first core portion 40*a* and the second core portion 40*b*. As illustrated in FIG. 2, the first mounting portion 24 is lead out to a lower surface of the first core portion 40*a* by the first bent portion 24*d*, and the first narrow portion 24*c* connected to the first bent portion 24*d* extends toward a first side surface 41 of the core 40 along the third direction (Y-axis direction). Furthermore, the first wide portion 24*a* is connected to an end portion in a Y-axis negative direction of the first narrow portion 24*c*. The first wide portion 24*a* extends from the end portion of the first narrow portion 24*c* toward a second core portion 40*b* side in the first direction (X-axis direction).

As illustrated in FIG. 4, the first narrow portion 24*c* overlaps only the first core portion 40*a* as seen from the second direction (Z-axis direction), whereas the first wide portion 24*a* is disposed to overlap both of the first core portion 40*a* and the second core portion 40*b* as seen from the second direction (Z-axis direction). In addition, as illustrated in FIG. 4, the first wide portion 24*a* is disposed very close to the first side surface 41 that is a side surface of the core 40, the side surface being parallel to the first direction (X-axis direction) and the second direction (Z-axis direction), and is closer to the first mounting portion 24 than to the second mounting portion 26.

As illustrated in FIGS. 2 and 4, the first mounting portion 24 includes the first cutout portion 24*b* that is disposed further apart from the first side surface 41 than the first wide portion 24*a*. Since the first cutout portion 24*b* is formed between the first bent portion 24*d* and the first wide portion 24*a*, the first wide portion 24*a* is accurately disposed along a direction (X-axis direction) different from the direction of the first bent portion 24*d*.

As illustrated in FIG. 4, the second mounting portion 26 has a shape that is symmetrical to the shape of the first mounting portion 24 with respect to a symmetry axis parallel to an X-axis. As illustrated in FIGS. 2 and 4, the second mounting portion 26 includes a second wide portion 26*a*, a second cutout portion 26*b*, a second narrow portion 26*c*, and a second bent portion 26*d*. The second wide portion 26*a* and the second narrow portion 26*c* extend along the same plane as the plane in which the first wide portion 24*a* and the first narrow portion 24*c* are disposed. The second bent portion 26*d* connects the second connecting portion 22*b* (refer to FIG. 5) parallel to the Y-Z plane and the second narrow portion 26*c* parallel to the X-Y plane. As illustrated in FIG. 5, the plate material forming the conductor 20 is bent 90° in the second bent portion 26*d*.

As illustrated in FIG. 4, the length in the first direction (X-axis direction) of the second wide portion 26*a* is equal to the length L3 along the first direction (X-axis direction) of the first wide portion 24*a*. As illustrated in FIG. 2, the second mounting portion 26 is lead out to the lower surface of the first core portion 40*a* by the second bent portion 26*d*, and the second narrow portion 26*c* connected to the second bent portion 26*d* extends toward a second side surface 42 of the core 40 along the third direction (Y-axis direction). Furthermore, the second wide portion 26*a* is connected to an end portion in a Y-axis positive direction of the second narrow portion 26*c*. The second wide portion 26*a* extends from the end portion of the second narrow portion 26*c* toward the second core portion 40*b* side in the first direction (X-axis direction).

As illustrated in FIG. 4, the second narrow portion 26*c* overlaps only the first core portion 40*a* as seen from the second direction (Z-axis direction), whereas the second wide portion 26*a* is disposed to overlap both of the first core portion 40*a* and the second core portion 40*b* as seen from the second direction (Z-axis direction). In addition, as illustrated in FIG. 4, the second wide portion 26*a* is disposed very close to the second side surface 42 that is a side surface of the core 40, the side surface being parallel to the first direction (X-axis direction) and the second direction (Z-axis direction), and is closer to the second mounting portion 26 than to the first mounting portion 24.

In addition, similar to the first mounting portion 24, the second mounting portion 26 includes the second cutout portion 26*b* that is disposed further apart from the second side surface 42 than the second wide portion 26*a*. Since the second cutout portion 26*b* is formed between the second bent portion 26*d* and the second wide portion 26*a*, the second wide portion 26*a* is accurately disposed along a direction (X-axis direction) different from the direction of the second bent portion 26*d*.

As illustrated in FIG. 4, the first mounting portion 24 and the second mounting portion 26 are disposed between the first side surface 41 and the second side surface 42 that are two side surfaces parallel to the first direction (X-axis direction) and the second direction (Z-axis direction) among side surfaces of the core 40 as seen from the second direction (Z-axis direction). In addition, the first mounting portion 24 and the second mounting portion 26 are disposed between a third side surface 43 and a fourth side surface 44 that are two side surfaces parallel to the third direction (Y-axis direction) and the second direction (Z-axis direction) among the side surfaces of the core 40 as seen from the second direction (Z-axis direction). As described above, since the first mounting portion 24 and the second mounting portion 26 are disposed not to protrude from an outer periphery of the core 40 as seen from the Z-axis direction, the projected area of the inductor element 10 on the mounting surface can be reduced.

As illustrated in FIG. 6, it is preferable that a length L6 in the first direction (X-axis direction) of the core 40 is shorter than a length L7 in the third direction (Y-axis direction) of the core 40. Since a short side direction of a cross section of the core 40, the cross section being perpendicular to a height direction, coincides with a short side direction of the same cross section of each of the first connecting portion 22*a* and the second connecting portion 22*b*, the inductor element 10 can be effectively reduced in thickness.

As illustrated in FIG. 1, an upper opening 47 may be formed in an upper surface of the core 40. Since the upper opening 47 is formed, heat occurring around the connecting portion 22 accommodated in the core 40 can be efficiently radiated to the outside. The upper opening 47 may be closed with a tape member 50. The material of the tape member 50 is, for example, polyimide.

As illustrated in FIG. 3, the core 40 includes a protrusion portion 46 which protrudes to the one side of the second direction (Z-axis negative direction) so that a lower end surface 46*a* of the protrusion portion 46 is positioned between the first mounting portion 24 and the second mounting portion 26. Since the inductor element 10 including the protrusion portion 46 has improved stability in mounting posture, the element can be more suitably prevented from falling over.

As illustrated in FIGS. 2 and 4, since the mounting portions 24 and 26 include the wide portions 24*a* and 26*a*, even if the inductor element 10 is thin, the element can be prevented from falling over. In addition, since the first wide portion 24*a* and the second wide portion 26*a* are disposed in both end portions in the Y-axis direction, the inductor element 10 has good stability when placed in a mounting posture. Therefore, in the inductor element 10, it is possible to effectively prevent a problem that the element falls over in the period from after the element is disposed on a substrate until joining by soldering or the like is completed.

Second Embodiment

Figure 7:
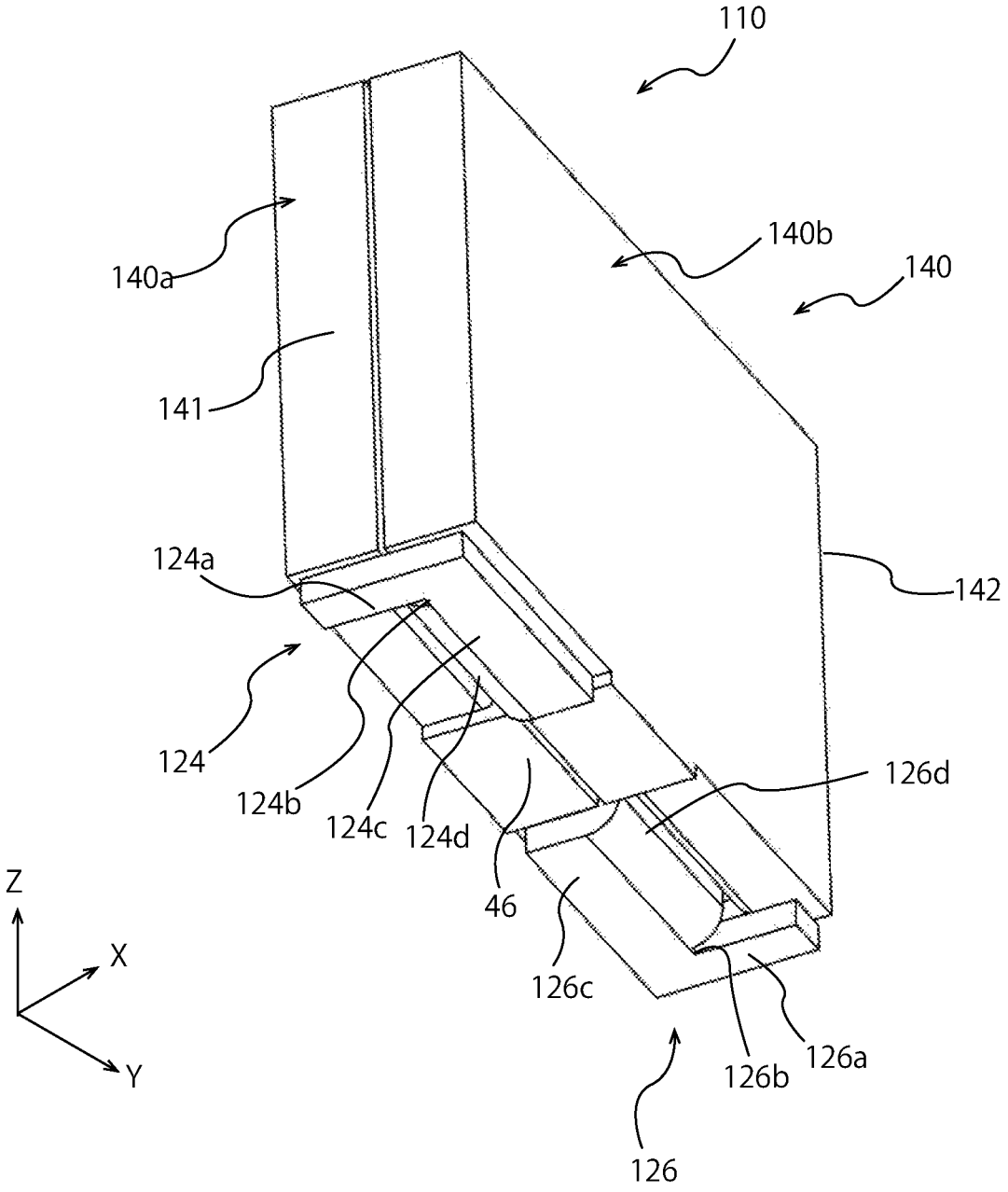
FIG. 7 is a perspective view of an inductor element according to a second embodiment of the invention as seen from diagonally below.

FIG. 7 is a perspective view of an inductor element 110 according to a second embodiment of the invention as seen from diagonally below. The inductor element 110 differs from the inductor element 10 according to the first embodiment in that a first core portion 140*a* and a second core portion 140*b* forming a core 140 are symmetrical in shape, a second mounting portion 126 has a shape rotated by 90° with respect to a first mounting portion 124, and the like. The points of difference of the inductor element 110 over the inductor element 10 will be mainly described, and a description of points in common with the inductor element 10 will be omitted.

Figure 8:
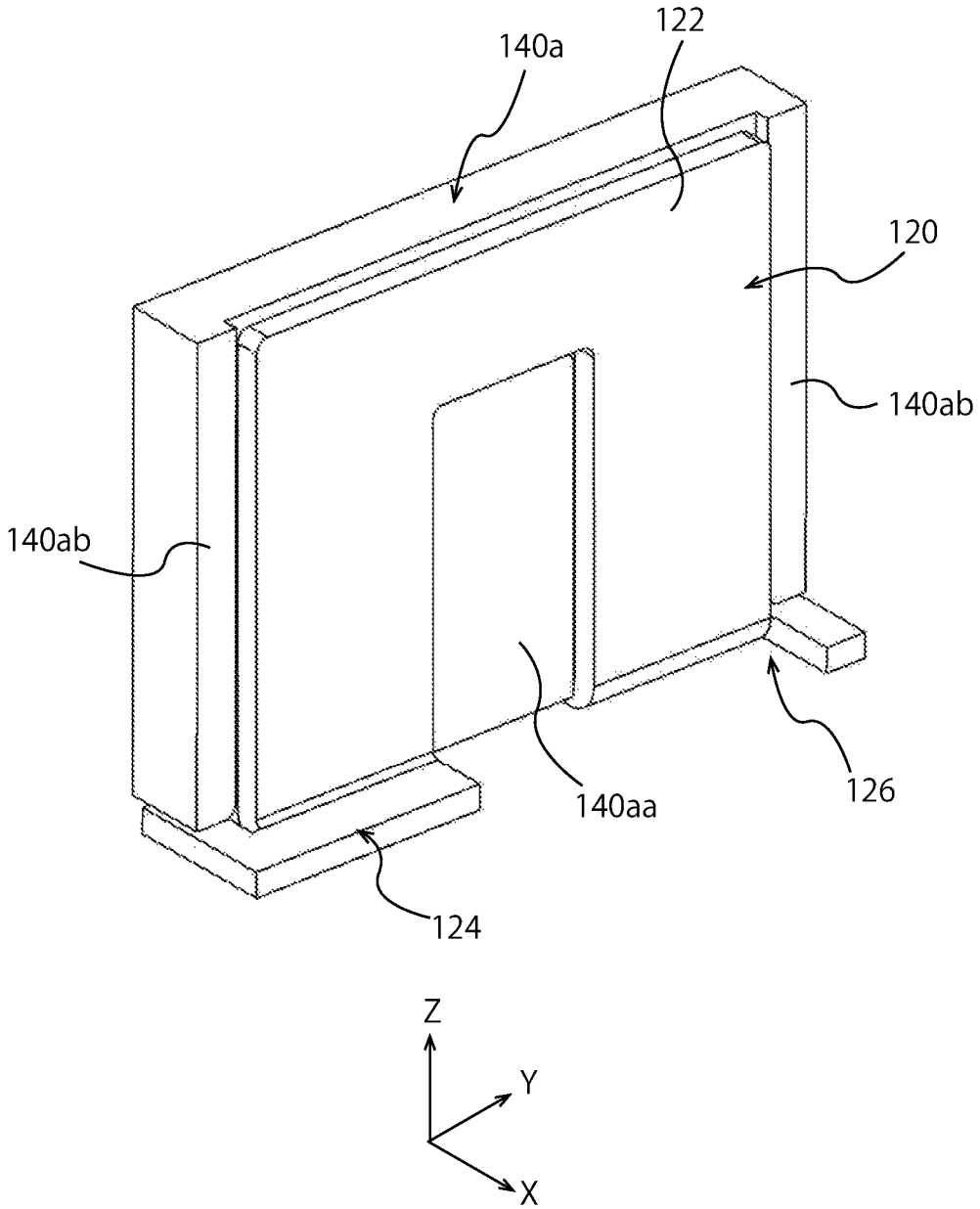
FIG. 8 is a partial assembly view of the inductor element illustrated in FIG. 7.

FIG. 8 is a partial assembly view of the inductor element 110 illustrated in FIG. 7, and illustrates a dispositional relationship between the first core portion 140*a* and a conductor 120. Similar to the first core portion 40*a* illustrated in FIG. 5, a central portion 140*aa* and side portions 140*ab* are formed in a surface of the first core portion 140*a*, which faces the second core portion 140*b*. However, the amount of protrusion of the central portion 140*aa* and the side portion 140*ab* that protrude toward the second core portion 140*b* is smaller than that in the first core portion 40*a* illustrated in FIG. 5.

Figure 9:
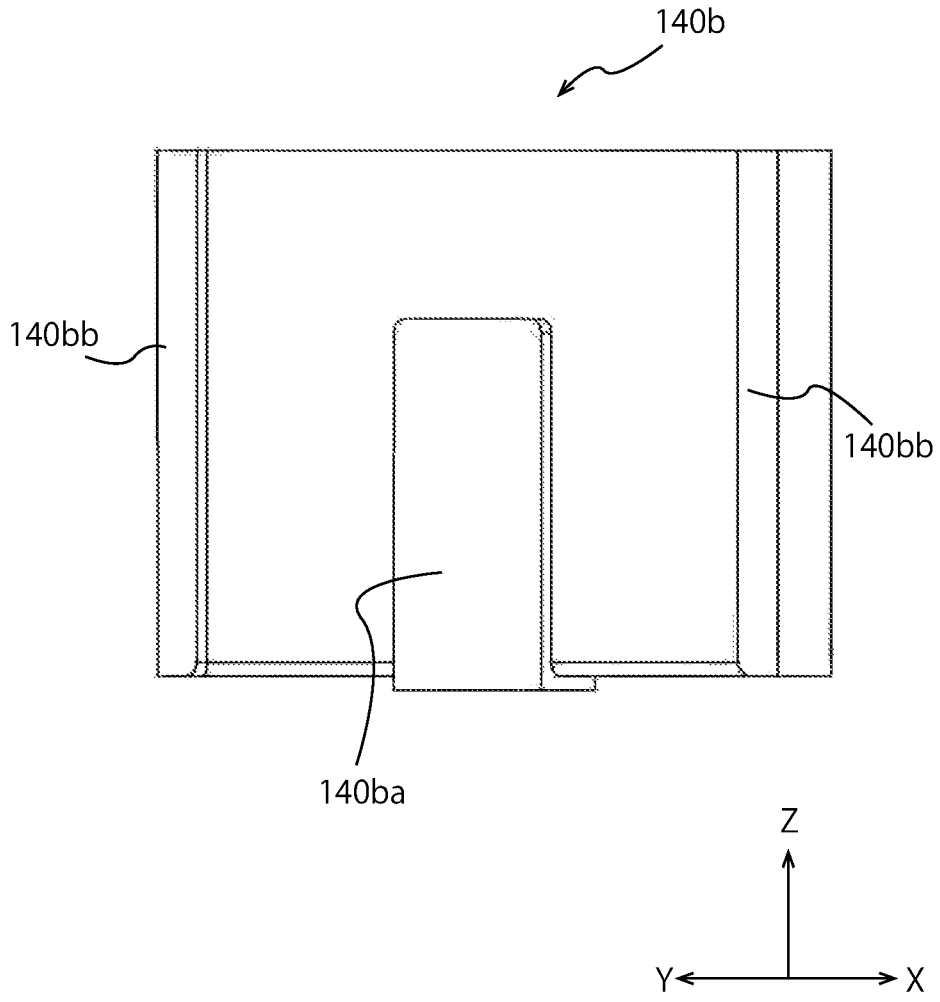
FIG. 9 is a perspective view of a second core portion provided in the inductor element illustrated in FIG. 7.

FIG. 9 is an external view of the second core portion 140*b*, and illustrates the shape of a surface of the second core portion 140*b*, which faces the first core portion 140*a*. Similar to the first core portion 140*a* illustrated in FIG. 8, a central portion 140*ba* and side portions 140*bb* are formed in the surface of the second core portion 140*b*, which faces the first core portion 140*a*. The core 140 illustrated in FIG. 7 is configured such that the central portion 140*aa* of the first core portion 140*a* abuts the central portion 140*ba* of the second core portion 140*b*, and the side portions 140*ab* of the first core portion 140*a* abut the side portions 140*bb* of the second core portion 140*b*.

A connecting portion 122 of the conductor 120 illustrated in FIG. 8 is interposed and accommodated between the first core portion 140*a* and the second core portion 140*b*. As illustrated in FIG. 8, the first mounting portion 124 and the second mounting portion 126 are connected via the connecting portion 122 passing between the first core portion 140*a* and the second core portion 140*b*. The schematic shape of the connecting portion 122 is the same as that of the connecting portion 22 illustrated in FIG. 5.

As illustrated in FIG. 7, the first mounting portion 124 includes a first wide portion 124*a*, a first cutout portion 124*b*, a first narrow portion 124*c*, and a first bent portion 124*d*. The first mounting portion 124 is lead out to a lower surface of the second core portion 140*b* by the first bent portion 124*d*, and the first narrow portion 124*c* connected to the first bent portion 124*d* extends toward a first side surface 141 of the core 140 along the third direction (Y-axis direction). Furthermore, the first wide portion 124*a* is connected to an end portion in the Y-axis negative direction of the first narrow portion 124*c*. The first wide portion 124*a* extends from the end portion of the first narrow portion 124*c* toward a first core portion 140*a* side in the first direction (X-axis direction).

As illustrated in FIG. 7, the first narrow portion 124*c* overlaps only the second core portion 140*b* as seen from the second direction (Z-axis direction), whereas the first wide portion 124*a* is disposed to overlap both of the first core portion 140*a* and the second core portion 140*b* as seen from the second direction (Z-axis direction). In addition, as illustrated in FIG. 7, the first wide portion 124*a* is disposed very close to the first side surface 141 that is a side surface of the core 140, the side surface being parallel to the first direction (X-axis direction) and the second direction (Z-axis direction), and is closer to the first mounting portion 124 than to the second mounting portion 126.

As illustrated in FIG. 7, the second mounting portion 126 includes a second wide portion 126*a*, a second cutout portion 126*b*, a second narrow portion 126*c*, and a second bent portion 126*d*. The second mounting portion 126 is lead out to a lower surface of the first core portion 140*a* by the second bent portion 126*d*, and the second narrow portion 126*c* connected to the second bent portion 126*d* extends toward a second side surface 142 of the core 140 along the third direction (Y-axis direction). Furthermore, the second wide portion 126*a* is connected to an end portion in the Y-axis positive direction of the second narrow portion 126*c*. The second wide portion 126*a* extends from the end portion of the second narrow portion 126*c* toward a second core portion 140*b* side in the first direction (X-axis direction).

As illustrated in FIG. 7, the second narrow portion 126*c* overlaps only the first core portion 140*a* as seen from the second direction (Z-axis direction), whereas the second wide portion 126*a* is disposed to overlap both of the first core portion 140*a* and the second core portion 140*b* as seen from the second direction (Z-axis direction). In addition, as illustrated in FIG. 7, the second wide portion 126*a* is disposed very close to the second side surface 142 that is a side surface of the core 140, the side surface being parallel to the first direction (X-axis direction) and the second direction (Z-axis direction), and is closer to the second mounting portion 126 than to the first mounting portion 124.

As illustrated in FIG. 7, the second mounting portion 126 has a shape rotated by 90° with respect to the first mounting portion 124. The inductor element 110 including the first mounting portion 124 and the second mounting portion 126 described above has a good balance of shape and weight in the first direction (X-axis direction), and the inductor element 110 can be suitably prevented from falling over when placed in a mounting posture. In addition, the inductor element 110 has the same effect as the inductor element 10.

Third Embodiment

Figure 10:
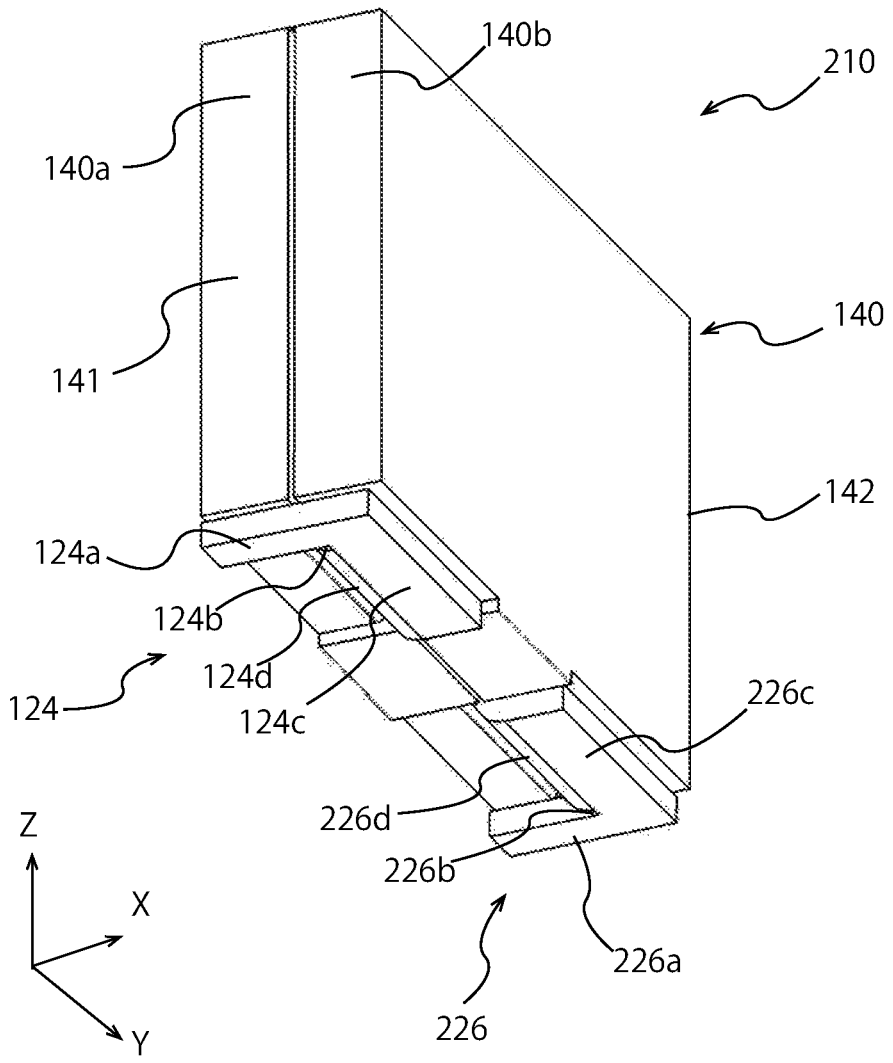
FIG. 10 is a perspective view of an inductor element according to a third embodiment of the invention as seen from diagonally below.

FIG. 10 is a perspective view of an inductor element 210 according to a third embodiment of the invention as seen from diagonally below. The inductor element 210 is the same as the inductor element 110 according to the second mounting portion except that the first mounting portion 124 and a second mounting portion 226 are symmetrical in shape with respect to a symmetry axis parallel to the X-axis. The points of difference of the inductor element 210 over the inductor element 110 will be mainly described, and a description of points in common with the inductor element 110 will be omitted.

The core 140 of the inductor element 210 illustrated in FIG. 10 is the same as that of the inductor element 110 illustrated in FIG. 7, whereas the shape of the second mounting portion 226 differs from that in the inductor element 110 illustrated in FIG. 7.

As illustrated in FIG. 10, the second mounting portion 226 includes a second wide portion 226*a*, a second cutout portion 226*b*, a second narrow portion 226*c*, and a second bent portion 226*d*. Similar to the first mounting portion 124, the second mounting portion 226 is lead out to the lower surface of the second core portion 140*b* by the second bent portion 226*d*, and the second narrow portion 226*c* connected to the second bent portion 226*d* extends toward the second side surface 142 of the core 140 along the third direction (Y-axis direction). Furthermore, the second wide portion 226*a* is connected to an end portion in the Y-axis positive direction of the second narrow portion 226*c*. The second wide portion 226*a* extends from the end portion of the second narrow portion 226*c* toward the first core portion 140*a* side in the first direction (X-axis direction).

Figure 11:
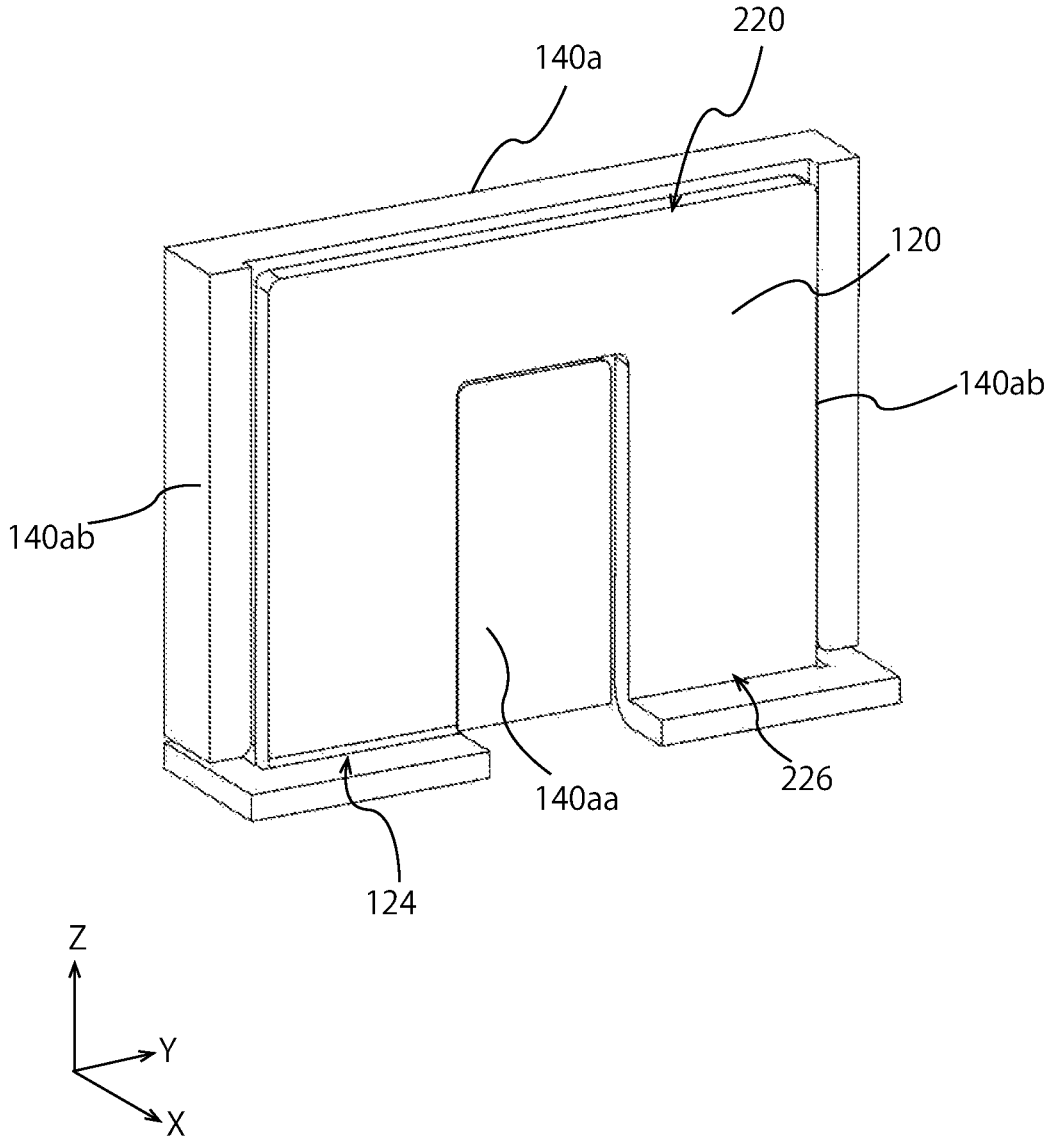
FIG. 11 is a partial assembly view of the inductor element illustrated in FIG. 10.

FIG. 11 is a partial assembly view of the inductor element 210 illustrated in FIG. 10, and illustrates a dispositional relationship between the first core portion 140*a* and a conductor 220. As illustrated in FIGS. 10 and 11, the second mounting portion 226 has a shape that is symmetrical to the shape of the first mounting portion 124 with respect to the symmetry axis parallel to the X-axis. Namely, the schematic shape of the conductor 220 in the inductor element 210 according to the third embodiment is the same as that of the conductor 20 in the inductor element 10 illustrated in FIG. 5. The inductor element 210 according to the third embodiment has the same effect as the inductor element 10 according to the first embodiment.

Fourth Embodiment

Figure 12:
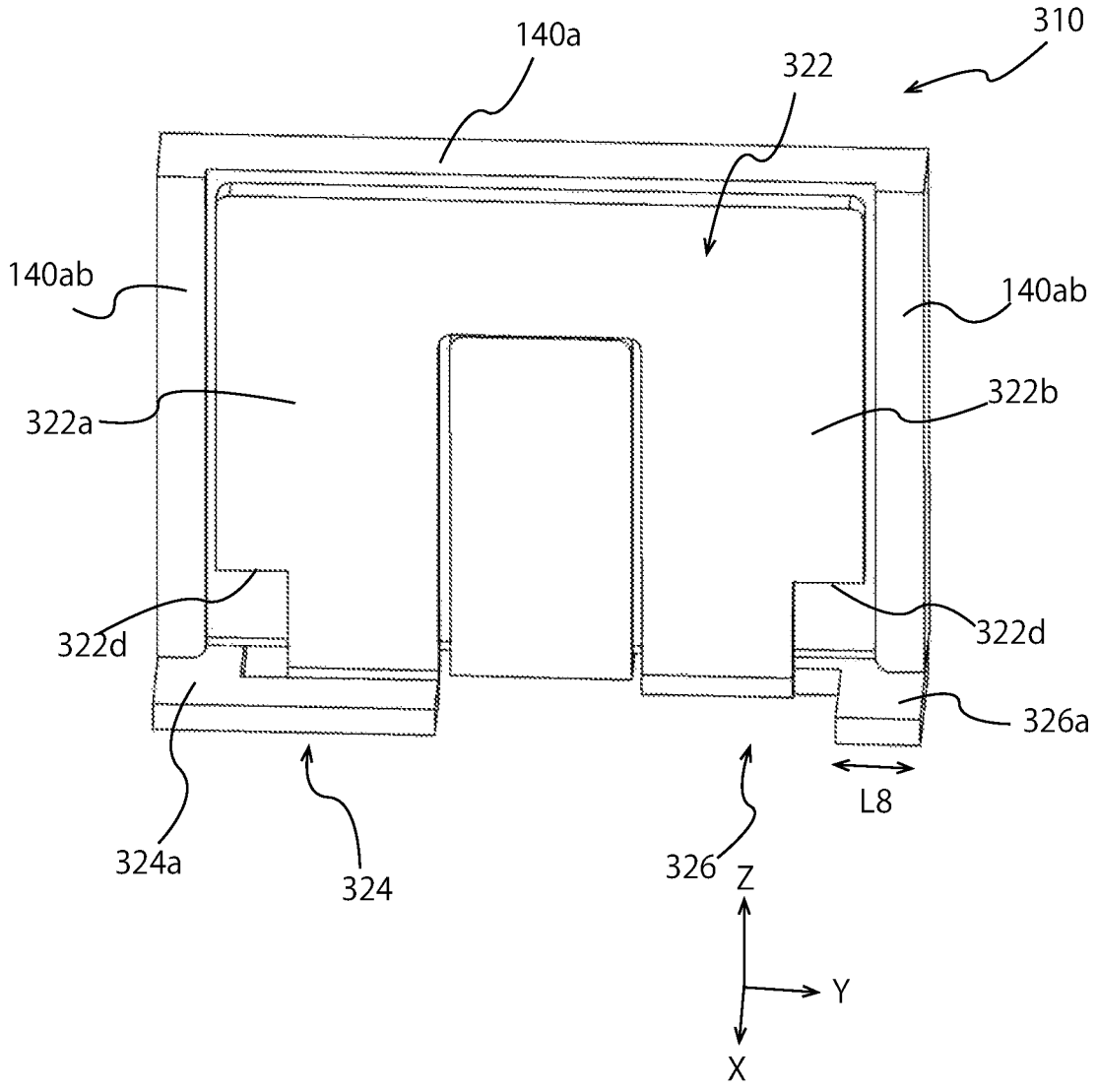
FIG. 12 is a partial assembly view of an inductor element according to a fourth embodiment of the invention.

FIG. 12 is a partial assembly view of an inductor element 310 according to a fourth embodiment of the invention, and illustrates a dispositional relationship between the first core portion 140*a* and a conductor 320. The inductor element 310 according to the fourth embodiment is the same as the inductor element 110 according to the second embodiment illustrated in FIGS. 7 to 9 except that lower cutout portions 322*d* are formed in a first connecting portion 322*a* and a second connecting portion 322*b* of the conductor 320 and the length along the Y-axis direction of wide portions 324*a* and 326*a* of first and second mounting portions 324 and 326. The points of difference of the inductor element 310 over the inductor element 110 will be mainly described, and a description of points in common with the inductor element 110 will be omitted.

As illustrated in FIG. 12, the lower cutout portions 322*d* are formed in the first connecting portion 322*a* and the second connecting portion 322*b*, which are accommodated between the first core portion 140*a* and the second core portion 140*b*, in the conductor 320 provided in the inductor element 310. The lower cutout portions 322*d* are lower portions of the first connecting portion 322*a* and the second connecting portion 322*b*, the lower portions being connected to the first mounting portion 324 and the second mounting portion 326, and are formed in positions very close to the side portions 140*ab* of the core 140.

Since the lower cutout portions 322*d* described above are formed, in the inductor element 310, a length L8 along the Y-axis direction of the wide portions 324*a* and 326*a* of the mounting portions 324 and 326 can be increased. The reason is that when the conductor 320 is manufactured by machining one plate material, parts of the plate material which are cut out to form the lower cutout portions 322*d* can be used as parts of the wide portions 324*a* and 326*a* of the mounting portions 324 and 326.

Since the length L8 in the Y-axis direction of the wide portions 324*a* and 326*a* of the first mounting portion 324 and the second mounting portion 326 can be increased, the inductor element 310 illustrated in FIG. 12 has good stability in mounting posture and can be suitably prevented from falling over. In addition, the inductor element 310 according to the fourth embodiment has the same effect as the inductor element 10 according to the first embodiment.

Fifth Embodiment

Figure 13:
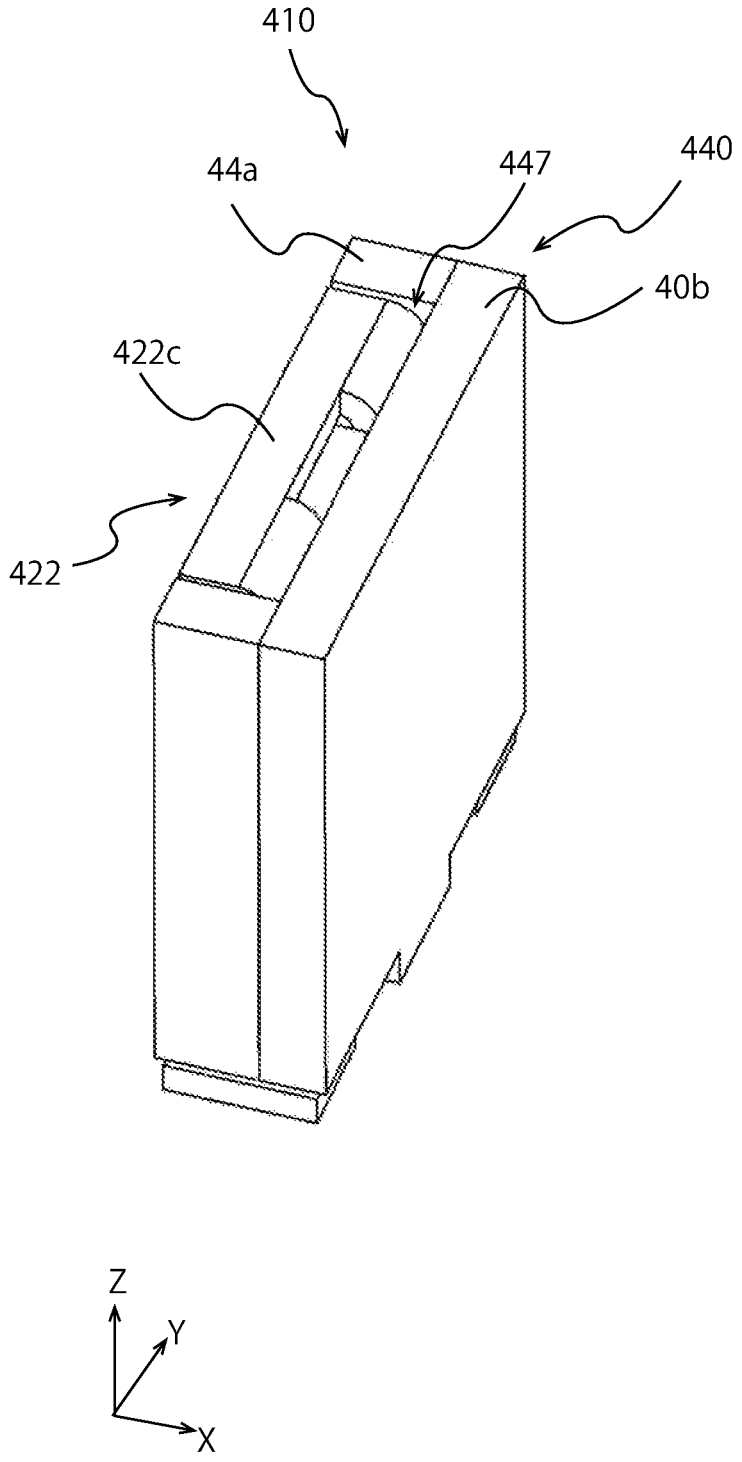
FIG. 13 is a perspective view of an inductor element according to a fifth embodiment of the invention as seen from diagonally above.

FIG. 13 is a perspective view of an inductor element 410 according to a fifth embodiment of the invention as seen from diagonally above. The inductor element 410 differs from the inductor element 10 according to the first embodiment in that an upper opening 447 of a core 440 is formed large and at least a part of a third connecting portion 422*c* of a conductor 420 has a plate shape extending perpendicular to the other portion of a connecting portion 422. The points of difference of the inductor element 410 over the inductor element 10 will be mainly described, and a description of points in common with the inductor element 10 will be omitted.

Figure 14:
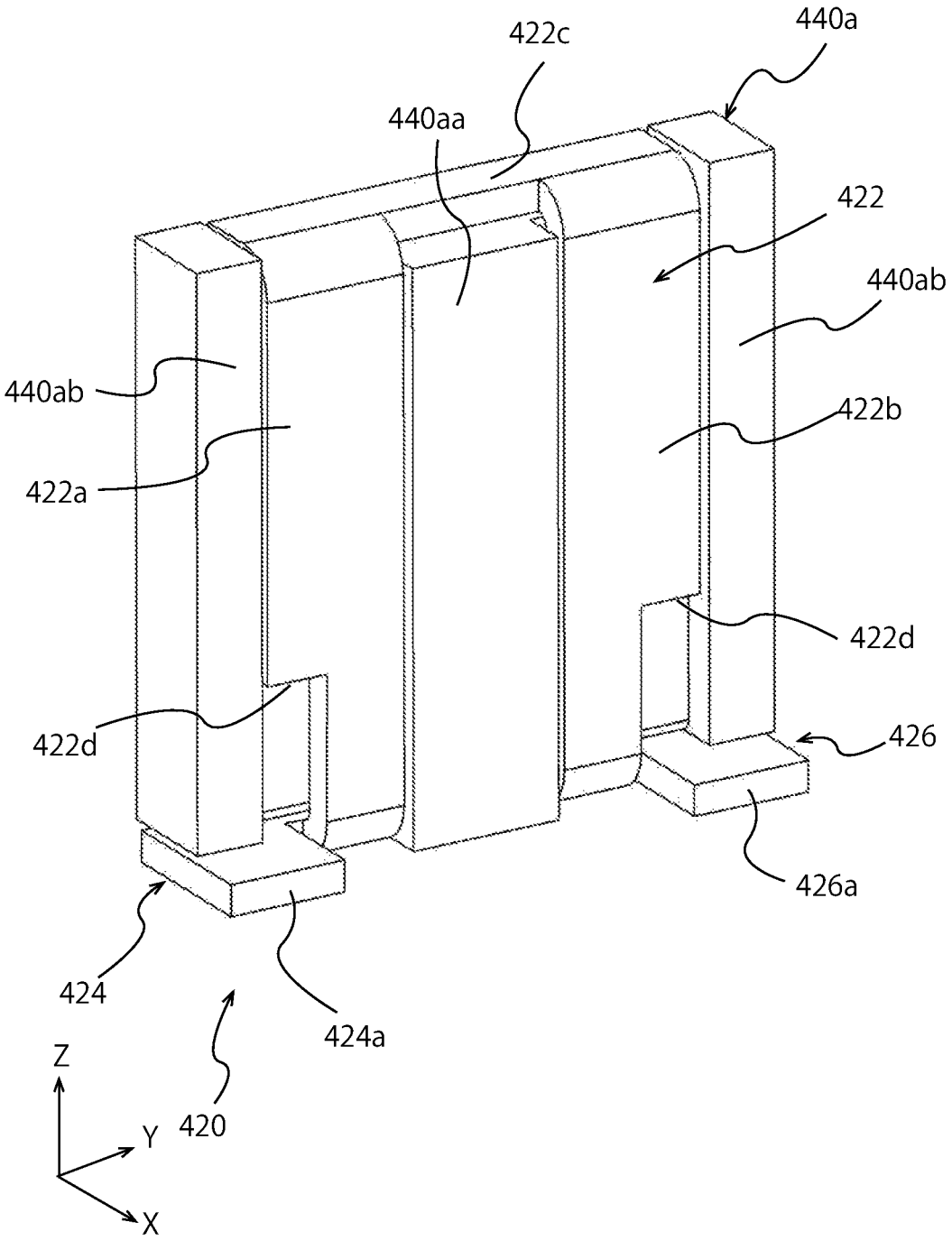
FIG. 14 is a partial assembly view of the inductor element illustrated in FIG. 13.

FIG. 14 is a partial assembly view of the inductor element 410 illustrated in FIG. 13, and illustrates a dispositional relationship between a first core portion 440*a* and the conductor 420. The height of a portion of the first core portion 440*a* except side portions 440*ab* is the same as the height of a central portion 440*aa*, and as illustrated in FIG. 13, the third connecting portion 422*c* is disposed substantially perpendicular to a first connecting portion 422*a* and a second connecting portion 422*b* so as to overlap the first core portion 440*a* from above as seen from the Z-axis direction. A part of the third connecting portion 422*c* is exposed from the upper opening 447 of the core 440.

As illustrated in FIG. 14, the third connecting portion 422*c* has a plate shape extending perpendicular to the first connecting portion 422*a* and the second connecting portion 422*b*. Incidentally, the state of extending perpendicular thereto incudes a case where the third connecting portion 422*c* extends in a direction to form, for example, an angle of 85 to 95° with respect to the first connecting portion 422*a* and the second connecting portion 422*b*. The connecting portion 422 described above can be formed by bending an upper end portion of the connecting portion 422, the upper end portion including the third connecting portion 422*c*, in a direction perpendicular to the first connecting portion 422*a* and the second connecting portion 422*b*.

In the inductor element 410 including the third connecting portion 422*c* described above, when the height of the inductor element 410 is constant, the length in the Z-axis direction of the first connecting portion 422*a* and the second connecting portion 422*b* can be further increased than that in the inductor element 10 illustrated in FIG. 1 in which the third connecting portion 422*c* is not bent. Therefore, in the inductor element 410, the property of the element can be improved while the height of the element is suppressed.

Incidentally, the inductor element 410 is the same as the inductor element 310 in that lower cutout portions 422*d* are formed in the first connecting portion 422*a* and the second connecting portion 422*b* and the widths in the Y-axis direction of a first wide portion 424*a* and a second wide portion 426*a* of first and second mounting portions 424 and 426 are wide. In addition, the inductor element 410 according to the fifth embodiment has the same effect as the inductor element 10 according to the first embodiment.

Sixth Embodiment

Figure 15:
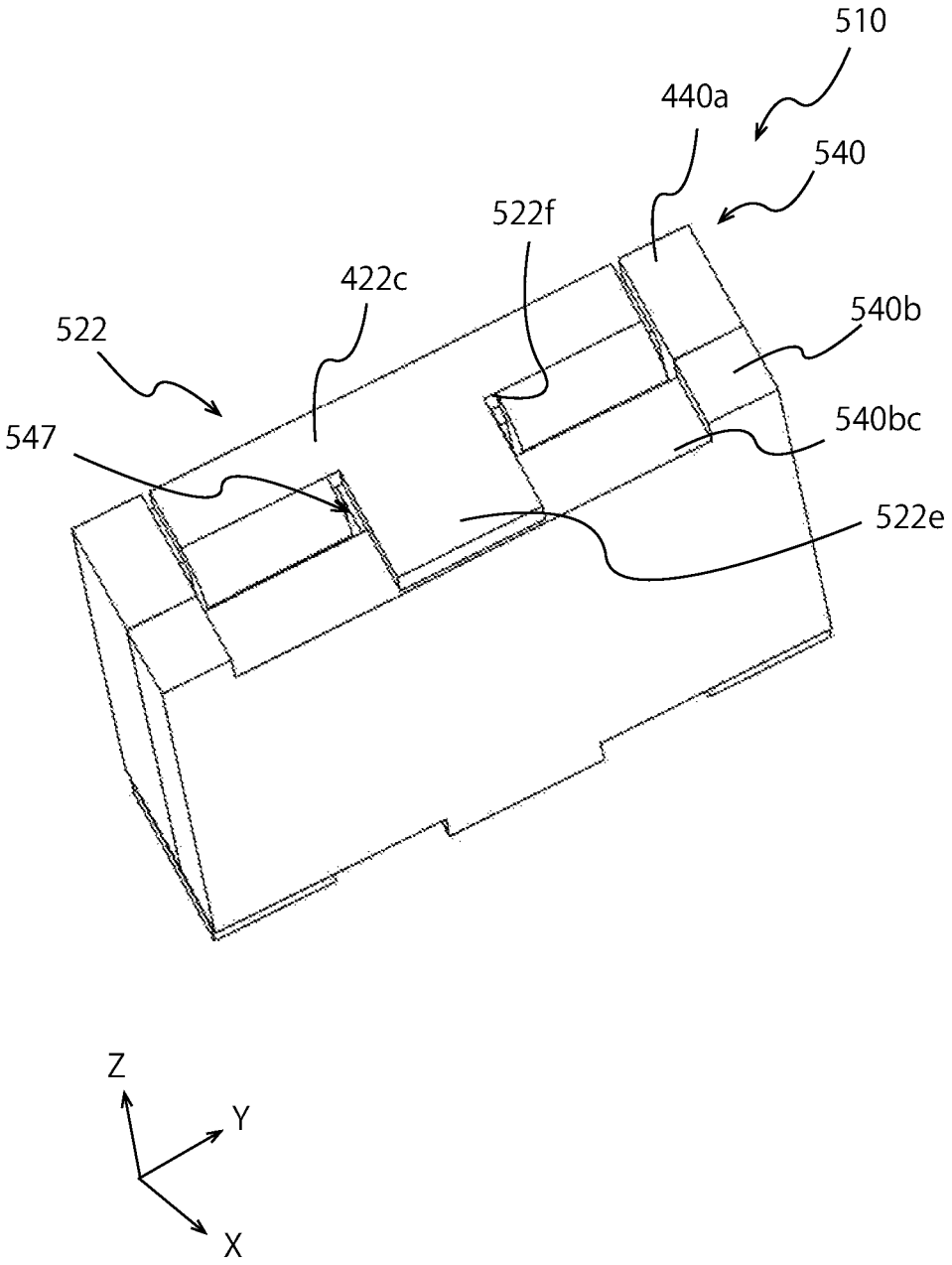
FIG. 15 is a perspective view of an inductor element according to a sixth embodiment of the invention as seen from diagonally above.

FIG. 15 is a perspective view of an inductor element 510 according to a sixth embodiment of the invention as seen from diagonally above. The inductor element 510 differs from the inductor element 410 according to the fifth embodiment in that the third connecting portion 422*c* and a central flat portion 522*e* of a conductor 520 are disposed in an upper opening 547 of a core 540 and an upper step portion 540*bc* is formed at an upper end of a second core portion 540*b* of the core 540. The points of difference of the inductor element 510 over the inductor element 410 will be mainly described, and a description of points in common with the inductor element 410 will be omitted.

Figure 16:
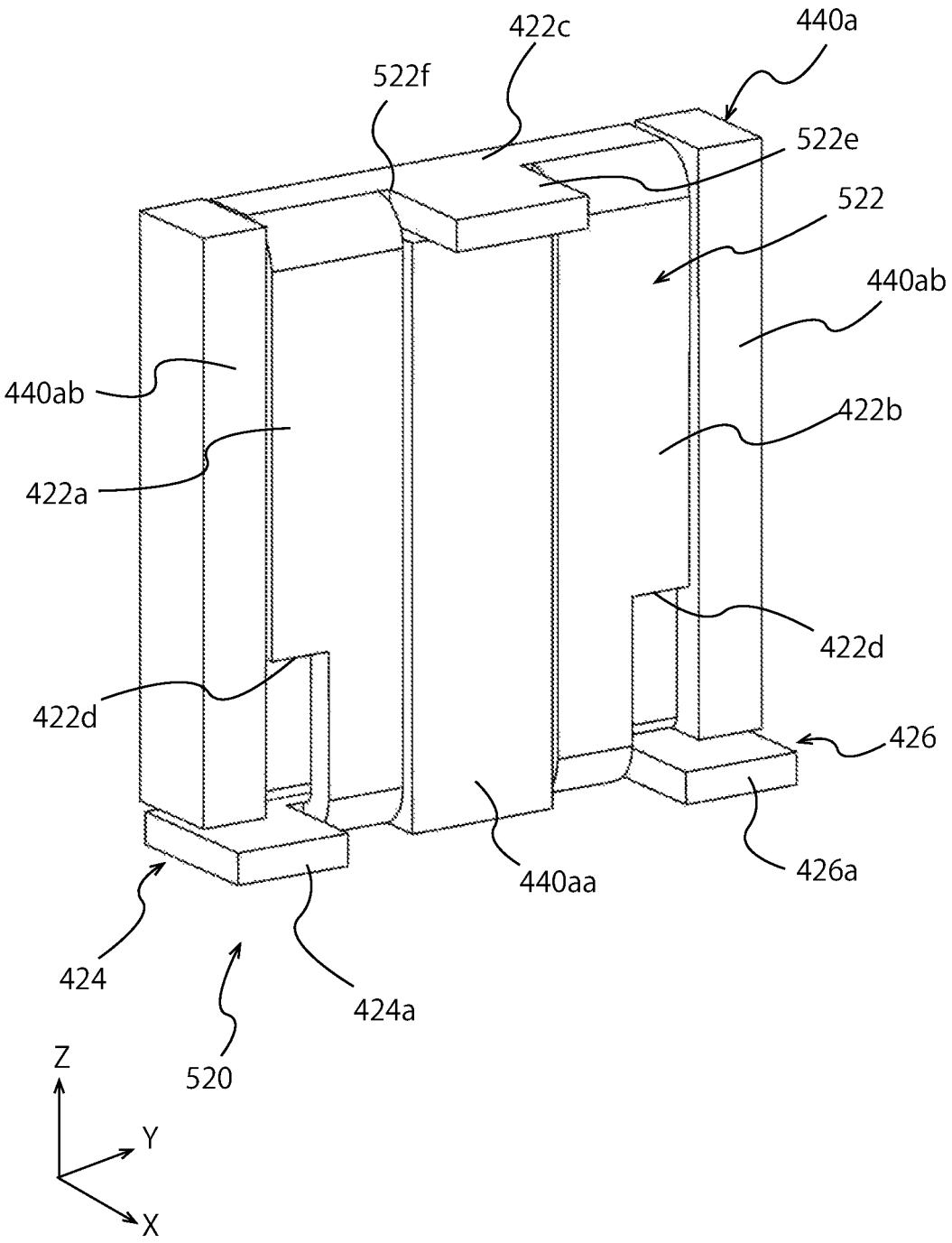
FIG. 16 is a partial assembly view of the inductor element illustrated in FIG. 15.

FIG. 16 is a partial assembly view of the inductor element 510 illustrated in FIG. 15, and illustrates a dispositional relationship between the first core portion 440*a* and the conductor 520. The first core portion 440*a* is the same as the first core portion 440*a* of the inductor element 410 illustrated in FIG. 14. A connecting portion 522 of the conductor 520 includes the central flat portion 522*e*, which extends in the same plane as the third connecting portion 422*c*, in addition to the first to third connecting portions 422*a* to 422*c*. The central flat portion 522*e* extends from a central portion in the Y-axis direction of the third connecting portion 422*c* toward a second core portion 540*b* side.

As illustrated in FIG. 15, the upper step portion 540*bc* having the same height as that of the central portion 440*aa* of the first core portion 440*a* is formed at the upper end of the second core portion 540*b*. A part of the central flat portion 522*e* is disposed to overlap the upper step portion 540*bc* as seen from the second direction. As illustrated in FIG. 16, upper cutout portions 522*f* are formed on both sides in the third direction (Y-axis direction) of the central flat portion 522*e*. The first mounting portion 424, the second mounting portion 426, and the first to third connecting portions 422*a* to 422*c* in the conductor 520 are the same as those in the conductor 420 according to the fifth embodiment.

In the inductor element 510 according to the sixth embodiment, as illustrated in FIG. 15, the central flat portion 522*e* of the conductor 520 is disposed in the upper opening 547 of the core 540. For this reason, in the inductor element 510, even if the tape member 50 (refer to FIG. 1) that closes the opening as in the inductor element 10 is not disposed, the central flat portion 522*e* of the inductor element 510 is suctioned by a suction nozzle of a mounting machine to be smoothly transported to a mounting position on the mounting substrate. In addition, the inductor element 510 has the same effect as the inductor element 410 according to the fifth embodiment.

Seventh Embodiment

Figure 17:
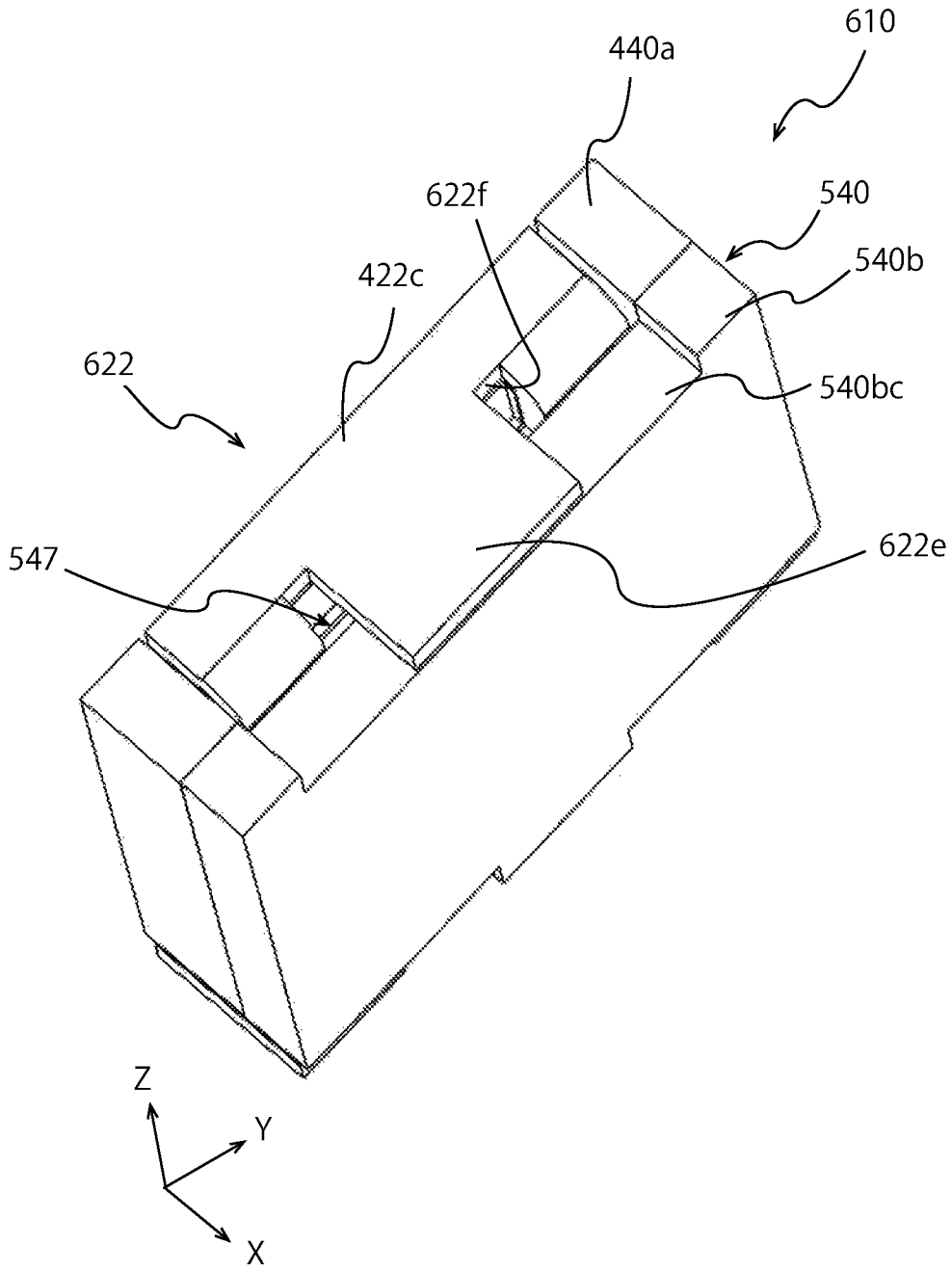
FIG. 17 is a perspective view of an inductor element according to a seventh embodiment of the invention as seen from diagonally above.

FIG. 17 is a perspective view of an inductor element 610 according to a seventh embodiment of the invention as seen from diagonally above. In that the width in the third direction (Y-axis direction) of a central flat portion 622*e* is wide and upper cutout portions 622*f* are widened to a first connecting portion 622*a* and a second connecting portion 622*b*, the inductor element 610 differs from the inductor element 510 according to the sixth embodiment, but is the same in other points as the inductor element 510 according to the sixth embodiment. The points of difference of the inductor element 610 over the inductor element 510 will be mainly described, and a description of points in common with the inductor element 510 will be omitted.

Figure 18:
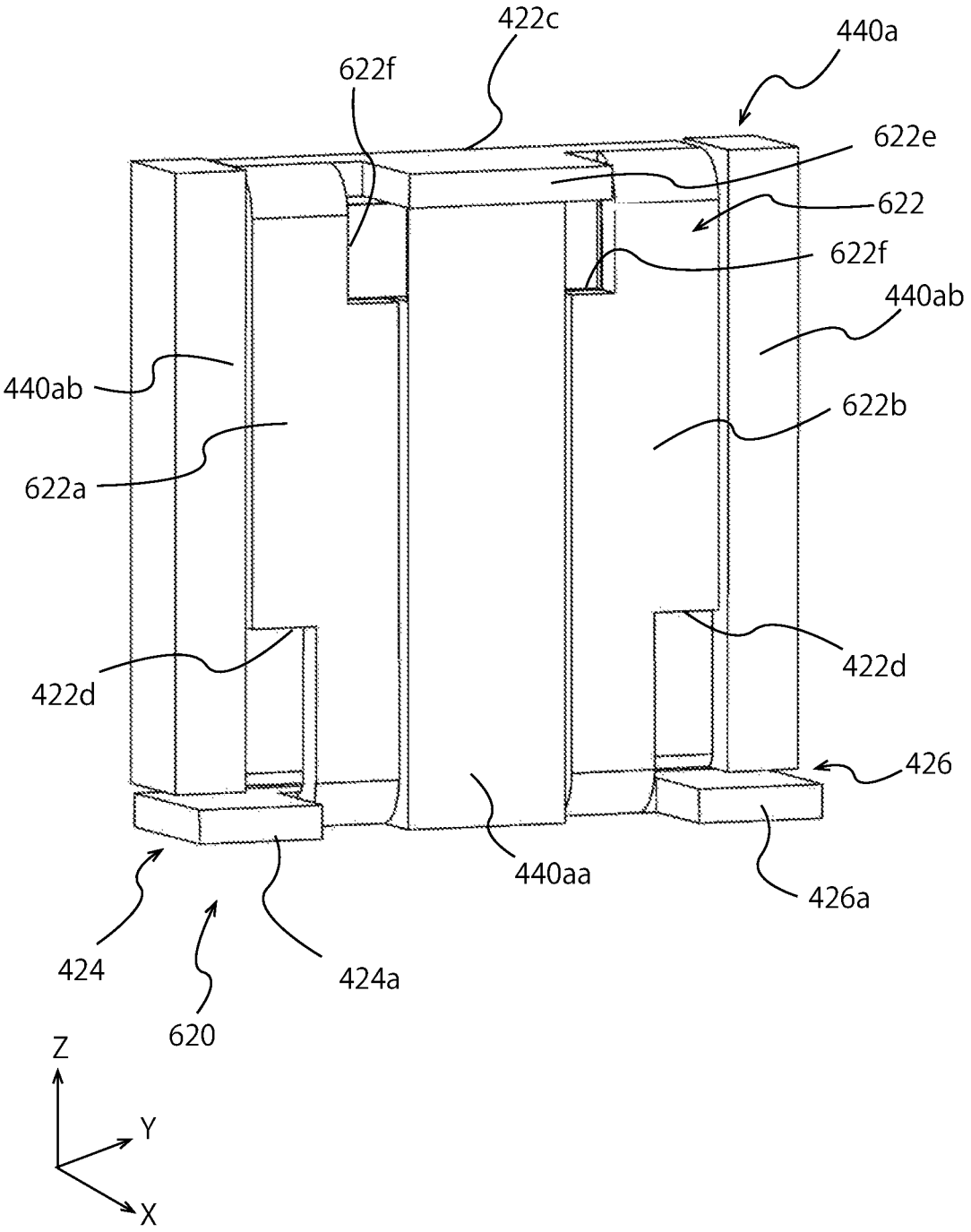
FIG. 18 is a partial assembly view of the inductor element illustrated in FIG. 15.

FIG. 18 is a partial assembly view of the inductor element 610 illustrated in FIG. 17 and illustrates a dispositional relationship between the first core portion 440*a* and a conductor 620. Incidentally, the core 540 provided in the inductor element 610 is the same as the core 540 provided in the inductor element 510 according to the sixth embodiment. As illustrated in FIG. 18, the width in the Y-axis direction of the central flat portion 622*e* of the conductor 620 is wider than the width in the Y-axis direction of the central portion 440*aa* of the first core portion 440*a*.

As illustrated in FIG. 18, the upper cutout portions 622*f* are formed on both sides in the third direction (Y-axis direction) of the central flat portion 622*e*. The upper cutout portions 622*f* continues to the first connecting portion 622*a* and the second connecting portion 622*b* of the conductor 620. As described above, since the upper cutout portions 622*f* are widened to the first connecting portion 622*a* and the second connecting portion 622*b*, the width in the Y-axis direction of the central flat portion 622*e* of the conductor 620 can be increased. Therefore, the range of suction attainable by the suction nozzle of the mounting machine can be secured, and even if the inductor element 610 is reduced in size, the inductor element 610 can be suitably transported by the mounting machine. In addition, the inductor element 610 has the same effect as the inductor element 510 according to the sixth embodiment. Incidentally, regarding the relationship of perpendicularity and parallelism between surfaces and directions described in the embodiments, it is acceptable that the surfaces and directions are substantially perpendicular or substantially parallel to each other, and the surfaces and directions are not necessarily strictly perpendicular or parallel to each other.

What is claimed is:

1. An inductor element comprising:

a core including a first core portion and a second core portion that are disposed face to each other in a first direction; and a conductor including;

a first mounting portion exposed from a bottom surface of the core, the first mounting portion including;

a first narrow portion; and a first wide portion perpendicular to the first narrow portion and overlapping the first core portion and the second core portion as seen from a second direction orthogonal to the first direction;

a second mounting portion exposed from the bottom surface of the core, the second mounting portion being disposed apart from the first mounting portion in a third direction perpendicular to the first direction and the second direction, the second mounting portion including;

a second narrow portion extending over the bottom surface of the core in a direction away from the first mounting portion along the third direction; and a second wide portion perpendicular to the second narrow portion and overlapping the first core portion and the second core portion as seen from the second direction: and a connecting portion passing between the first core portion and the second core portion to connect the first mounting portion and the second mounting portion, wherein the first narrow portion extends over the bottom surface of the core in a direction away from the second mounting portion along the third direction.

2. The inductor element according to claim 1, wherein the connecting portion includes a first connecting portion extending from the first mounting portion along the second direction, a second connecting portion extending from the second mounting portion along the second direction, and a third connecting portion that connects the first connecting portion and the second connecting portion along the third direction , and a length along the first direction of a cross section of each of the first connecting portion and the second connecting portion, the cross section being orthogonal to the second direction that is a direction of a current, is shorter than a length along the third direction of the cross section.

3. The inductor element according to claim 2, wherein the third connecting portion is disposed on the same plane as the first connecting portion and the second connecting portion.

4. The inductor element according to claim 2, wherein at least a part of the third connecting portion has a plate shape extending perpendicular to the first connecting portion and the second connecting portion.

5. The inductor element according to claim 1, wherein a length along the first direction of the first wide portion is longer than lengths along the first direction of both of the first core portion and the second core portion, a length along the first direction of the second wide portion is longer than the lengths along the first direction of both of the first core portion and the second core portion, the first wide portion is disposed closer than the second wide portion to a first side surface of core that is parallel to the first direction and the second direction, and the second wide portion is disposed closer than the first wide portion to a second side surface that is parallel to the first direction and the second direction .

6. The inductor element according to claim 5, wherein the first mounting portion includes a first cutout portion that is disposed further from the first side surface than is the first wide portion, and the second mounting portion includes a second cutout portion that is disposed further from the second side surface than is the second wide portion.

7. The inductor element according to claim 1, wherein, as seen from the second direction, the first mounting portion and the second mounting portion are disposed between a first side surface of the core and a second side surface of the core that are parallel to the first direction and the second direction, and are disposed between a third side surface of the core and a fourth side surface of the core that are parallel to the third direction and the second direction.

8. The inductor element according to claim 1, wherein the core includes a protrusion portion which protrudes from the bottom surface of the core in the second direction so that a lower end surface of the protrusion portion is positioned between the first mounting portion and the second mounting portion.

9. The inductor element according to claim 1, wherein a length along the first direction of the core is shorter than a length along the second direction of the core and a length along the third direction of the core.

10. The inductor element according to claim 1, wherein p1 a length along the third direction of the first wide portion is shorter than a length along the first direction of the first narrow portion, a length along the third direction of the second wide portion is shorter than a length along the first direction of the second narrow portion, and the first wide portion and the second wide portion are not exposed outside an outer edge of the bottom surface of the core with respect to the third direction as seen from the second direction.

11. The inductor element according to claim 10, wherein both of the first wide portion and the first narrow portion are not exposed outside the outer edge of the bottom surface of the core as seen from the second direction, and both of the second wide portion and the second narrow portion are not exposed outside the outer edge of the bottom surface of the core as seen from the second direction.

* * * * *